US011814961B2

(12) United States Patent
Schmitt

(10) Patent No.: US 11,814,961 B2
(45) Date of Patent: Nov. 14, 2023

(54) SHIFTING HEAD ASSISTED ROTARY POSITIVE DISPLACEMENT DEVICE

(71) Applicant: ThermalTech Holdings, LLC, Westport, CT (US)

(72) Inventor: Joshua M. Schmitt, San Antonio, TX (US)

( * ) Notice: Subject to any disclaimer, the term of this patent is extended or adjusted under 35 U.S.C. 154(b) by 0 days.

(21) Appl. No.: 17/407,883

(22) Filed: Aug. 20, 2021

(65) Prior Publication Data

US 2021/0381506 A1 Dec. 9, 2021

Related U.S. Application Data

(63) Continuation-in-part of application No. 16/963,080, filed on Jul. 17, 2020, now Pat. No. 11,333,101, and a continuation-in-part of application No. 16/461,947, filed on May 17, 2019, now abandoned.

(51) Int. Cl.

| | |
|---|---|
| ***F01C 1/344*** | (2006.01) |
| ***F04C 29/04*** | (2006.01) |
| ***F04C 2/344*** | (2006.01) |
| ***F01C 21/08*** | (2006.01) |
| ***F01C 20/18*** | (2006.01) |

(52) U.S. Cl.

CPC ..... *F01C 1/3442* (2013.01); *F01C 20/18* (2013.01); *F01C 21/0845* (2013.01); *F04C 2/344* (2013.01); *F04C 29/04* (2013.01); *F04C 2210/105* (2013.01); *F04C 2210/222* (2013.01); *F04C 2210/227* (2013.01)

(58) Field of Classification Search

CPC ..... F04C 2/344–3445; F04C 18/344–3445; F04C 14/18–226; F04C 28/18–22; F01C 1/344–3445; F01C 20/18–22

See application file for complete search history.

(56) References Cited

U.S. PATENT DOCUMENTS

| | | | | |
|---|---|---|---|---|
| 2009/0148324 | A1* | 6/2009 | Mordukhovich | F04C 14/20 418/17 |
| 2010/0071368 | A1* | 3/2010 | Kaplan | F01K 7/18 60/651 |
| 2010/0156112 | A1* | 6/2010 | Held | F01K 25/103 290/1 A |
| 2014/0000447 | A1* | 1/2014 | Ting | F01C 21/0809 91/325 |
| 2020/0248686 | A1* | 8/2020 | Zubeidat | F04C 14/24 |

FOREIGN PATENT DOCUMENTS

| | | | | |
|---|---|---|---|---|
| DE | 1800577 | A1 * | 6/1970 | |
| WO | WO-9822696 | A1 * | 5/1998 | F01C 1/32 |

* cited by examiner

*Primary Examiner* — Laert Dounis
(74) *Attorney, Agent, or Firm* — Verrill Dana, LLP

(57) ABSTRACT

A positive displacement expander with an operating fluid chamber of expansive volume regulated by a shifting head. The shifting head may enhance rotation of a housing utilized to rotate a shaft for providing work to any of a variety of power retrieval devices. Additional efficiencies may also be realized through unique hydraulic layouts for circulating of the operating fluid from a heat exchanger, through the rotary device and to a cold exchanger for continuous operating of the rotary device.

19 Claims, 5 Drawing Sheets

SHIFTING HEAD ASSISTED ROTARY POSITIVE DISPLACEMENT DEVICE

CROSS REFERENCE TO RELATED APPLICATION

This patent Document is a Continuation-In-Part claiming priority under 35 U.S.C. § 120 to U.S. application Ser. No. 16/461,947, entitled "High Dynamic Density Range Thermal Cycle Engine", filed May 17, 2019, and under 35 U.S.C. § 120 to U.S. application Ser. No. 16/963,080, entitled "Floating Head Piston Assembly", filed Nov. 5, 2020, each of which is incorporated herein by reference in its entirety.

BACKGROUND

Over the years, efforts have been undertaken to obtain work or power through an engine that is driven by different types of thermodynamic cycles. For example, techniques for generating electrical power from equipment relying on the "Brayton", "Stirling" or "Organic Rankine" cycle (ORC) have been developed. Unfortunately, these technologies have been generally ineffective and inefficient, employing lower heat sources, say below the boiling point of water.

By way of example, ORC equipment or engine manufacturers often provide a system that allows for practical operation with input heat temperatures as low as 170° F. However, as a result, this may only be rendered where a dramatically reduced output is also attained, thereby making the undertaking significantly less economical. In part, this is due to the fact that the method of operation uses two phase changes per cycle, from liquid to gas and back again, and uses turbine or turbine-like technology to convert the pneumatic forces of the gas to generate productive work.

Alternative technologies for converting very low grade heat into usable work are also options. Very low grade heat, defined herein as below the boiling point of water at sea level is such an example. Unfortunately, most of these technologies are also inefficient or unproductive due to reliance on the Organic Rankine thermodynamic cycle, which requires converting a liquid to a gas and back again. That is, two phase changes per cycle are necessitated. Thus, these "thermal pneumatic heat engines" face an inherent challenge in terms of efficiency.

ORC engines convert a liquid with a low boiling temperature, such as a refrigerant, to gas and then channels the gas, or a gas-and-liquid mixture, through a turbine-like device to produce rotary motion. Such engines operate at a "low" rotational speed of near 5,000 rpm. The gas mixture is then cooled back to a liquid state, changing phase again before reuse. Even setting aside these natural phase change inefficiencies, the speed and dramatic phase changes create significant noise, not unlike a jet engine.

Another technology that has been attempted is known as "thermal hydraulic heat engines". These engines involve the use of heat applied to a liquid that may have a relatively high coefficient of expansion. As a practical matter, however, most liquids expand very little when heated and contract very little when cooled. Thus, in actual practice, such engines fail to attain successful commercialization due primarily to the difficulty of obtaining sufficient expansion, and sufficiently rapid expansion and contraction, in liquids. This, in turn, limits the economic viability of such engines. Further, even when utilized, such engines are only practical for use in a narrow set of specific circumstances, given the general inflexibility in terms of available modifications for differing uses. In fact, extensive trial and error is generally required even for the circumstances in which the engines may be effectively utilized. This is due, in part, to the inherent limitation involved with reliance on the expansion and contraction of a liquid by the introduction and removal of heat.

Further complicating matters is the fact that these types of engines generally include the use of a piston that is reciprocated by the alternating application of heated gas and cooled liquid, comparatively speaking. As a result, the piston is well suited for reciprocation in a linear manner. Thus, in theory, the added efficiencies of linear reciprocation may be available in generating work. However, as a practical matter, the ability to efficiently obtain work from such a linear reciprocating piston faces added challenges. That is, in addition to phase change and other engine inefficiencies that are commonplace with other thermal heat systems as noted above, as with any linearly reciprocating piston, a complete stop and reverse in direction is required with every stroke. However, due to the use of generally low input temperatures in facilitating stroking of the piston, the piston may face efficiency challenges with each stroke. This is because the piston reaching the end of a stroke must overcome forces from one direction for stroking in the opposite direction facilitated only by generally low input temperatures, generally below about 200° F.

SUMMARY

A method of obtaining power from a system by circulating an operating fluid to a rotary positive displacement device for rotation thereof. A shaft extending from the rotary device may be rotated by the device to supply work to a power retrieval device. Further, a position of a head in fluid communication with a chamber of the rotary device may be shifted to enhance the rotation.

DETAILED DESCRIPTION

Figure 1:
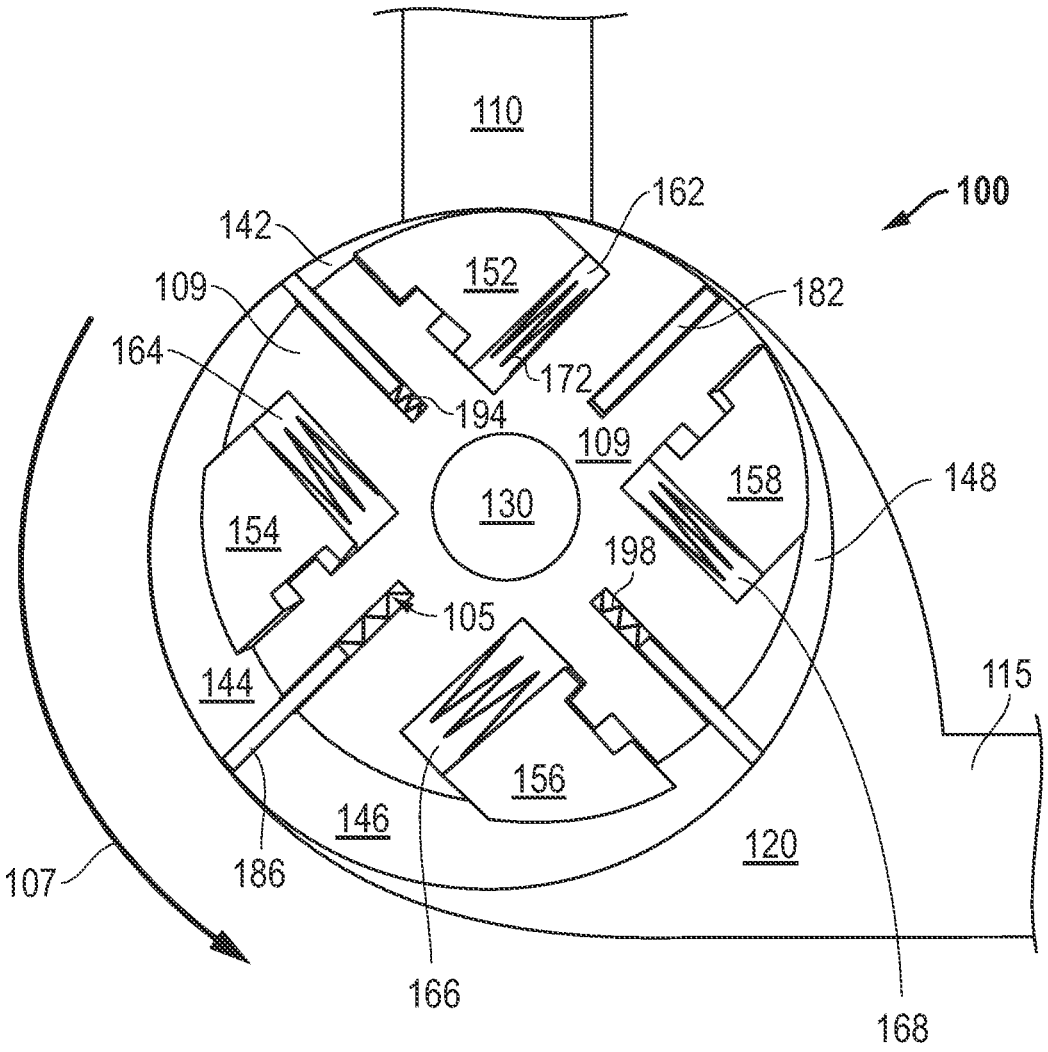
FIG. 1 is a side sectional view of an embodiment of a shifting head assisted rotary positive displacement device.

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described. For example, embodiments herein are described with reference to illustrations depicting a certain floating dual-head piston assembly system or engine. However, a variety of layouts may be employed, with additional piston assemblies incorporated, a host of additional valving or timing controls, etc. However, these system/engine layouts are merely illustrative as a variety of different hydraulic or even mechanical layouts and other design options may be employed depending on system constraints and the intended application.

Embodiments detailed herein may use the controlled expansion and contraction of a compressible fluid, perhaps supercritical fluid, to rotate a positive displacement device or "expander" for generating productive work. While it is not required that this operating fluid be a supercritical fluid, the system may govern a thermodynamic cycle similar to embodiments detailed in U.S. Provisional Patent Application 62/424,494 for a Thermal Cycle Engine and U.S. patent application Ser. No. 16/461,947 for a High Dynamic Density Range Thermal Cycle Engine, each of which is incorporated herein in its entirety. For example, the engine may display a "low" reciprocation speed of less than about 50 cycles per minute. Further, embodiments detailed herein may avoid changes in phase, and so are inherently more thermodynamically efficient, and with the appropriate operating fluid may operate effectively using input temperatures below 500° F. In fact, they can easily be tuned to operate with minor reductions in efficiency with input heat below 150° F. It also operates with greatly reduced noise.

As indicated, the embodiments detailed herein do not require the circulation of supercritical fluid. Additionally, a more complete circulation of the supercritical fluid may be utilized as detailed in U.S. Provisional Patent Application 62/618,689, for a Floating Head Opposing Piston Assembly and U.S. patent application Ser. No. 16/461,947 for a Floating Head Piston Assembly, each of which are also incorporated herein by reference in their entireties. In these embodiments, a unique floating head may be employed adjacent to a piston head to provide a sequentially timed, spring-like aid to filling the working fluid chamber and stroking of a piston for enhanced efficiency thereof. Embodiments which are the more specific focus of the specification below employ a rotary positive displacement expander. The expander is used to facilitate shaft rotation from which power may be drawn in place of working fluid circulation. Further, enhanced efficiency for this rotation may be drawn from spring-like shiftable heads within the rotary device as detailed herein.

Referring specifically now to FIG. 1, a side sectional view of an embodiment of a shifting head assisted rotary positive displacement device 100 is illustrated. The rotary device 100 is of a vane variety that employs a given number of different operating fluid chambers 142, 144, 146, 148, four in the case of the illustrated embodiment. However, any practical number of chambers 142-148 may be utilized. As with a conventional rotary expander device 100, a shaft 130 is ultimately rotated from which power may be attained as detailed below. This is achieved by the rotation of an offset housing 109 as illustrated (see arrow 107).

The offset housing 109, in combination with an adjacent or outer stationary casing 120 of the device 100 serves to define the chambers 142-148. So, for example, the uppermost illustrated chamber 142 is of the least volume due to the manner in which the offset housing 109 is in relation to the adjacent casing 120 at this location. However, with rotation of the housing 109 to the point that this chamber 142 reaches a lower position such as that occupied by the lowermost chamber 146, a substantial volume increase will be realized.

It is the offset nature of the housing 109 that is largely responsible for the change in volume of a given chamber 142-148 during a described rotation. However, the positional relationship between the housing 109 and the casing 120 is not the only architectural feature governing chamber volume. For example, each chamber 142-148 is defined by vane seals 182, 186 that extend and retract as necessary to meet the interior of the casing 120 to sealingly define each chamber 142-148 in spite of the changing volume. Note the vane chambers 105 and vane biasing mechanisms 194, 198 (e.g. mechanical springs) that facilitate or govern this movement of the vane seals 182. In a similar way, shifting heads 152, 154, 156, 158 may extend into and retract from the operating fluid chambers 142, 144, 146, 148 as described below. However, this shifting is based on pressure in the chambers 142-148 as opposed to the more direct physically adjacent location of the interior of the casing 120. Regardless, this shifting helps to further define the changing chamber volume and serves as an efficiency aid to the rotating of the housing 109 as also described below.

The shifting heads 152-158 may be thought of as pressure volume regulators (PVR's). With the aid of head biasing mechanisms 172 within head chambers 162, 164, 166, 168, the position of each head 152-158 may be a matter of the pressure in each chamber 142-148 versus the pressure supplied by the biasing mechanisms 172. For example, each mechanism 172 may be of a predetermined charge that is insufficient for overcoming pressure in a smaller chamber 142 of particularly heated operating fluid. However, as this fluid cools and the volume of the chamber increases (e.g. 144, 146), the biasing force from the mechanism 172 may begin to overcome the pressure in the adjacent chamber 142-148. For example, the pressure due to heat and limited initial volume of the chamber 142 may be at about 3,000 psi with a spring mechanism 172 rated at about 1,500 psi. However, as the operating chamber 142 increases in volume and the pressure reduces to about 1,200 psi and less, the spring 172 may begin to shift the head 152 as described. Of course, these pressures are only meant to be illustrative as any suitable range of pressure options may be employed.

A head 152-158 extending as described allows it to serve the indicated PVR function. It is of note that a spring is shown to illustrate the head biasing mechanisms 172. However, this is not required. As with the vane biasing mechanisms 194, 198, thrust pins, compressible fluid, air, an inert gas or any other suitable pressure supply mechanism may be employed.

With the above background of the rotary device 100 in mind, circulation of an operating fluid is now considered. Specifically, an operating fluid is introduced to the device 100 at an inlet 110 and, upon sufficient rotation of the housing 109 is ultimately guided to an outlet 115. During the intervening route through the device 100, the operating fluid is trapped within discrete chambers 142-148 and undergoes volumetric expansion. As each chamber 142-148 increases, pressure drops and the PVR shifting head 152-158 extends. As a result, the overall volume of the expansion is regulated in a manner that may help to reduce the amount of temperature drop in the operating fluid by the time it reaches the outlet 115.

The described PVR function may be particularly beneficial for applications where the operating fluid is a supercritical fluid such as $CO_2$, helium, steam, or other already lower temperature operating fluid even of a non-supercritical nature. Such fluids are generally beneficial in terms of circulation via efficient heating and cooling cycles. The operating fluid may be circulated through states of high temperature and pressure to states of low temperature and pressure, ultimately producing work. The addition of the described shifting head concept provides an energy storage and recovery device to the system which enhances the efficiency of this circulation through the rotary device 100. Ultimately the work attained from the device 100 may occur at a more enhanced and comparatively more consistent and smoother rate with the aid of the shifting heads 152-158.

Figure 2A:
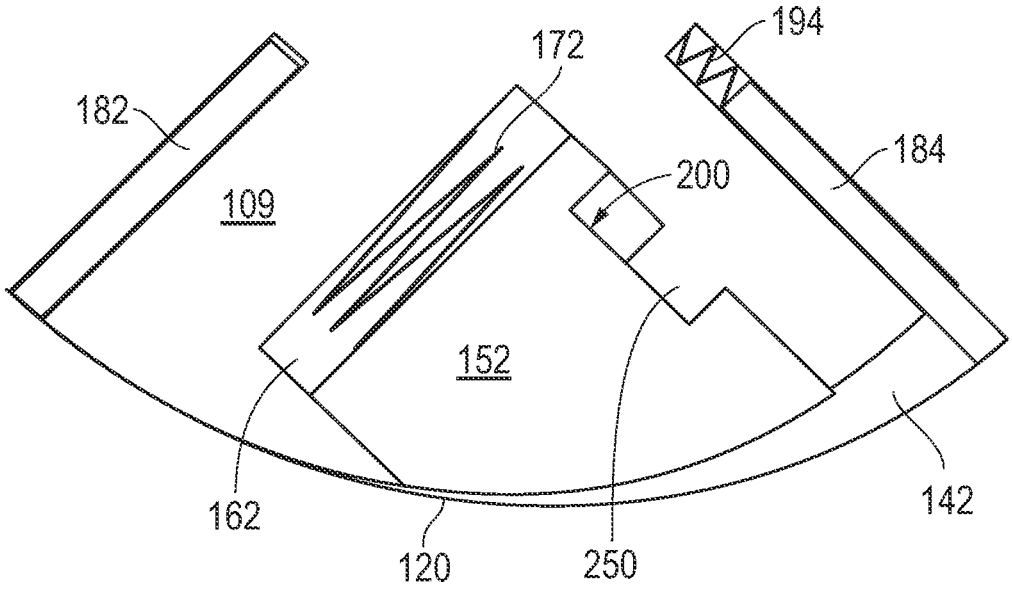
FIG. 2A is an enlarged view of an embodiment of a chamber of the rotary device of FIG. 1 with a shifting head in a first retracted position.
Figure 2B:
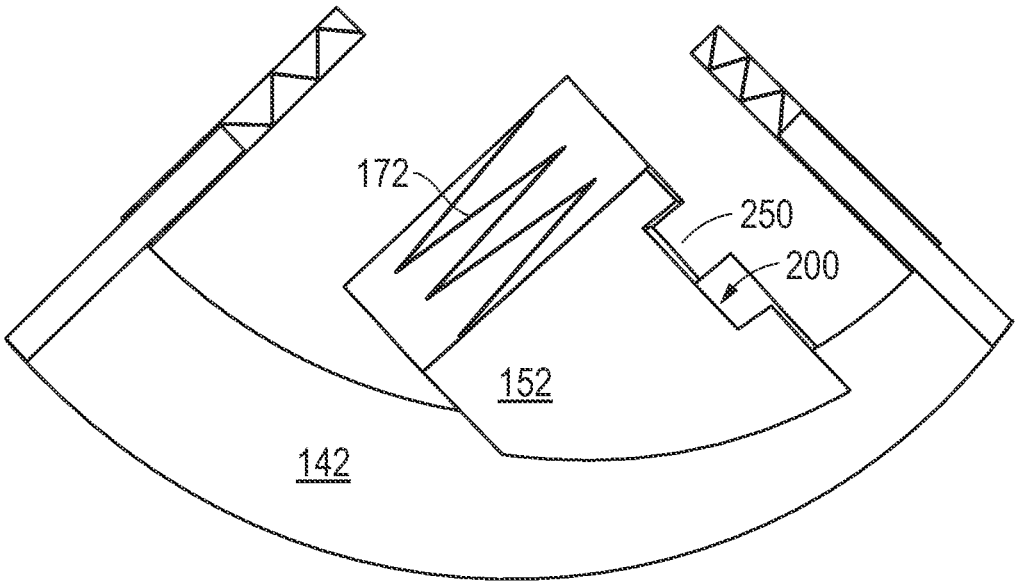
FIG. 2B is an enlarged view of the chamber of FIG. 2A with the shifting head in a second extended position

Referring now to FIGS. 2A and 2B, enlarged views of an embodiment of a chamber 142 of the rotary device 100 of FIG. 1 are illustrated. Specifically, FIG. 2A is an enlarged view of the shifting head 152 in a first retracted position relative the chamber 142 whereas FIG. 2B is an enlarged view of the shifting head 152 in a second extended position reaching into the chamber 142.

As the head 152 shifts positions in the manner described above, a constraint on the shifting is provided by a slot 200 in the head 152 that interfaces with a tab 250 of the housing 109 to define a set predetermined maximum range of motion. Note that with the head 152 retracted and the biasing mechanism 172 compressed, the interfacing of the slot 200 with the tab 250 provides one stop to the degree of retraction in FIG. 2A. Also note that in FIG. 2A, it is not the interior of the casing 120 that keeps the head 152 retracted. Rather, as the vane seals 182, 184 pass below the inlet 110 of the device 100 of FIG. 1, a discrete amount of operating fluid is attained for the chamber 142. With the temperature elevated and the volume of the chamber 142 at a minimum, the pressure therein keeps the head 152 retracted as described above. However, with added reference to FIG. 2B, once the rotation of the housing 109 has expanded the chamber 142, pressure therein is reduced and the head 152 extended as described above. With added reference to FIG. 1 though, the rotary nature of the device 100 is such that even with the cycling out of the operating fluid through the outlet 120, the chamber 142 will be refilled with operating fluid. Once more, this will occur with the fluid at an elevated temperature and at a time when the chamber 142 is at a minimal volume as the cycle continues.

Figure 3:
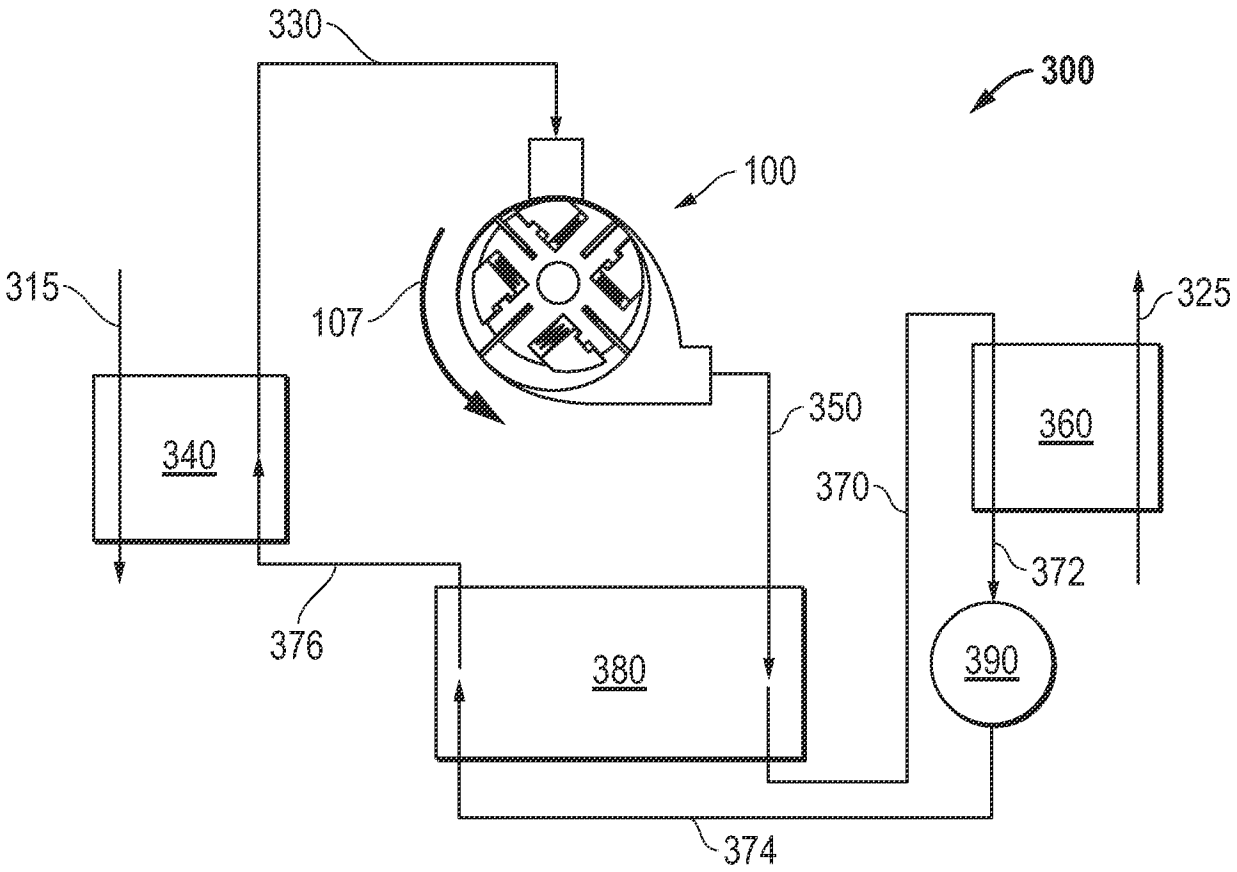
FIG. 3 is a schematic representation of a system employing a circulating operating fluid to direct the rotation of the rotary positive displacement device of FIG. 1.

Referring now to FIG. 3, a schematic representation of a system 300 is shown employing a circulating operating fluid to direct the rotation of the rotary positive displacement device 100 of FIG. 1. That is, in this view, an embodiment of a hydraulic layout is shown for the operating fluid as it is employed to rotate the device 100. Recall, that in turn, a shaft 130 will be rotated from which work may be obtained (e.g. see FIG. 4). Recall also that shifting heads 152-158 are employed with this rotation for enhanced cycling of the operating fluid through the system 300.

In the embodiment shown, an operating fluid such as heated supercritical $CO_2$ has been routed from a heat exchanger 340 along line 330 to the inlet of the rotary expander 100. As illustrated, a heat flow 315, for example, heated water may be used to maintain heat of the heat exchanger 340. In one embodiment, maintaining the heat flow may be done by any of a number of low grade heat sources. For example, geothermal heat, solar heat or the waste heat from other unrelated system operations may be utilized to maintain the flow 315 at between about 100° F. and 500° F. This allows for an effective and economical utilization of a vast array of heat sources previously considered to be too cool and of no practical economic value. Of course, in other embodiments, higher temperatures may be utilized.

Continuing with reference to FIG. 3, the operating fluid is routed to a cold exchanger 360. In the embodiment shown, a recuperator 380 is first introduced into the flow of the operating fluid before reaching the cold exchanger 360. The recuperator 380 may circulate operating fluid at an intermediate temperature, between that of the hot exchanger 340 and that of the cold exchanger 360. Thus, a more consistent and efficient temperature drop may be displayed by the operating fluid before it reaches the cold exchanger 360.

Furthermore, the heat is recovered into the operating fluid after the pump 390, requiring less heat exchange from heat exchanger 340, thus improving cycle efficiency. In the embodiment shown, a cold flow 325 may be used to facilitate heat removal from the operating fluid by the cold exchanger 360. This flow 325 may be drawn from room temperature water, evaporative cooling or other suitable means.

The cooled operating fluid, perhaps supercritical $CO_2$ that has been cooled from about 100° F. down to about 50° F., may then be pumped by an exchange pump 390 back through the recuperator 380 and eventually to the heat exchanger 340. Thus, the circulating of the operating fluid to rotary device 100 may be continued as described above.

Figure 4:
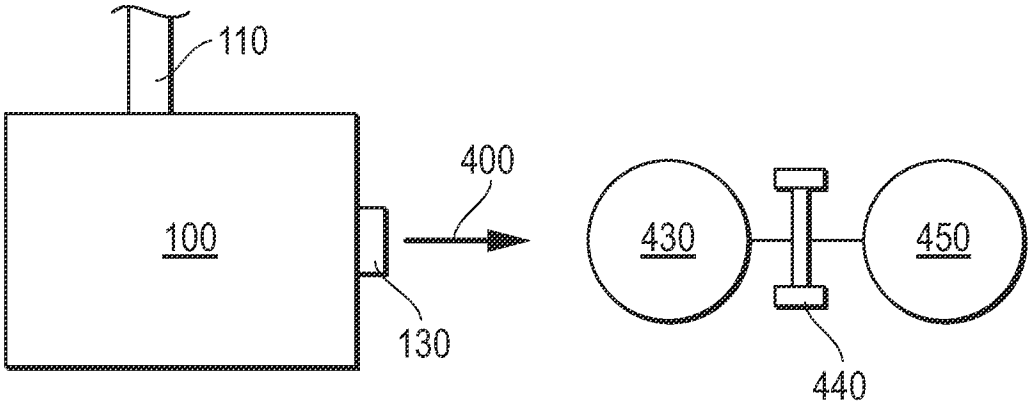
FIG. 4 is a schematic representation of the system of FIG. 3 obtaining work from rotary positive displacement device.

Referring now to FIG. 4, a schematic representation of the system of FIG. 3 is shown obtaining work from rotary positive displacement device 100. From the vantage point illustrated, the inlet 110 for the operating fluid is shown. However, the device 100 is oriented such that a side view of the rotated shaft 130 is apparent and not the outlet 120 of FIG. 1. With the device 100 continuously rotating the shaft 130 as described above, a working fluid er-force may be mechanically linked to a host of power retrieval devices (see arrow 400). In the embodiment shown, power retrieval devices may include a motor 430 linked to a flywheel 440 and a generator 450. However, any number of different power retrieval devices may be employed with the system and linked in a variety of manners with one another. So long as the motive force from the continuously rotating shaft 130 is facilitated by a shifting head rotary positive displacement device 100, appreciable benefit may be realized.

Figure 5:
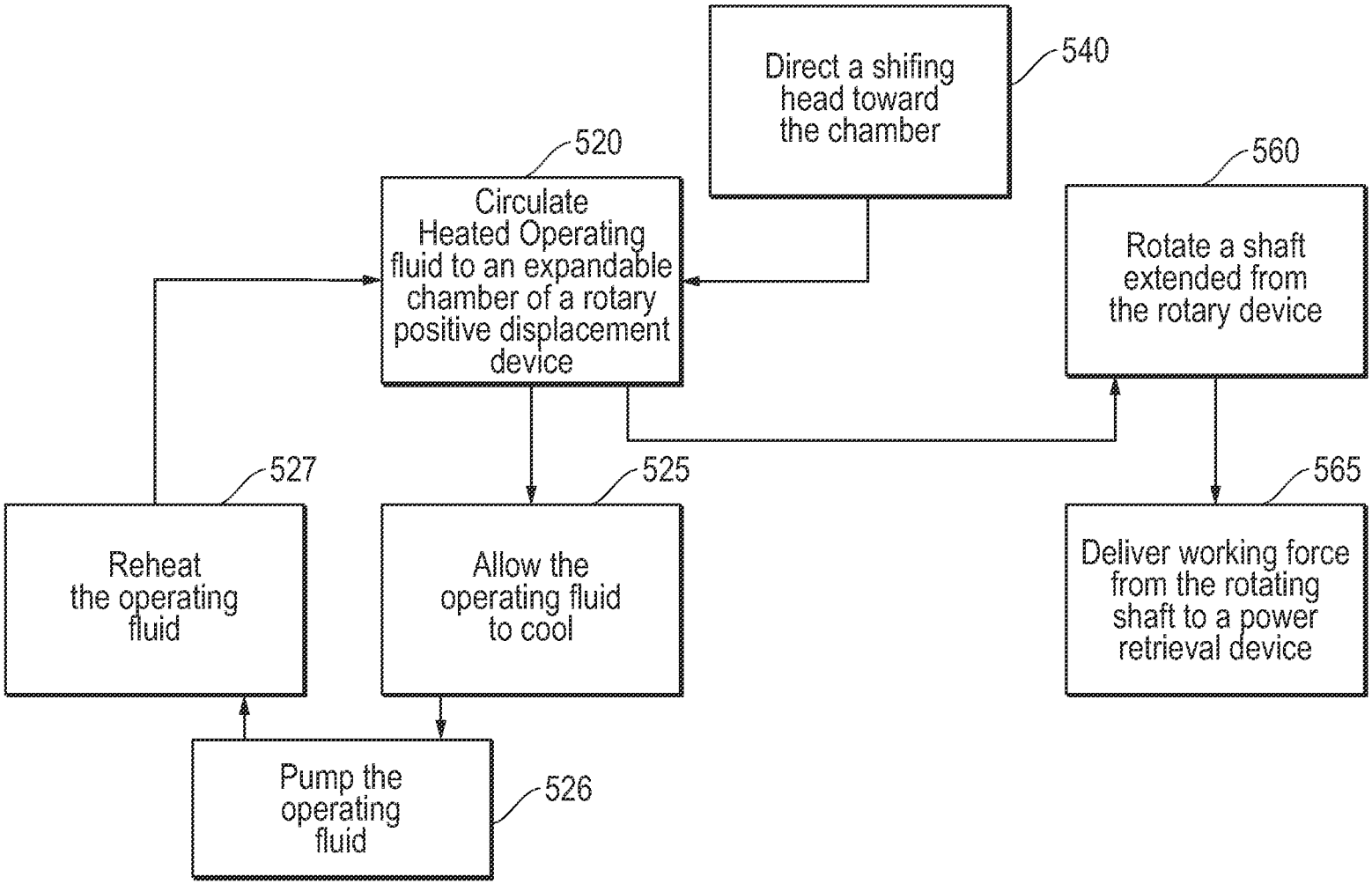
FIG. 5 is a flow-chart summarizing an embodiment of employing a shifting head with a rotary positive displacement driven system to produce work for supplying energy.

Referring now to FIG. 5, a flow-chart is depicted summarizing an embodiment of employing a shifting head with a rotary positive displacement driven system to produce work for supplying energy. Specifically, as shown at 520, 540 and 560, heated operating fluid is circulated to a rotary positive displacement device, specifically, a chamber thereof. This is done in order to rotate a shaft that extends from the device from which work may ultimately be attained. At this same time, a shifting head in communication with the chamber is also directed toward the volume of this chamber to help facilitate efficient rotation by way of smooth pressure regulation of the chamber. Ultimately the working force of the rotating shaft is delivered to one of a variety of power retrieval devices as noted at 565 and thus, a functioning engine is provided. The circulating operating fluid may then be allowed to cool 525, then be pumped 526 and eventually reheated 527 to continue the cycle.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. A rotary positive displacement device comprising:

a rotatable offset housing defining an operating fluid chamber;

a casing about the housing for altering a volume of the chamber;

at least one vane seal between the housing and an inner surface of the casing for further defining the chamber;

a position shiftable head of uniform maximum outer diameter for further defining the chamber to responsively regulate chamber volume in response to the altering thereof; and a tab of the housing for slidably interfacing with a parallel surface of a slot of the position shiftable head to establish a set predetermined maximum range of motion for the head between fully extended and fully retracted position limits, the fully retracted position limit determined exclusively by the interfacing of the tab and slot.

2. The device of claim 1 wherein the device is a vane expander.

3. The device of claim 2 further comprising a regulating mechanism accommodated by the housing to regulate one of a position of the head and a position of the vane seal.

4. The device of claim 3 wherein the regulating mechanism is selected from a group consisting of a spring, a thrust pin, a compressible fluid, air and an inert gas.

5. The device of claim 1 further comprising a shaft extending from the housing to beyond the casing for suppling work to a power retrieval device.

6. The device of claim 1 wherein the chamber accommodates an operating fluid selected from a group consisting of supercritical fluid, $CO_2$, helium and steam.

7. A system comprising:

a rotary positive displacement device with a volume expanding operating fluid chamber defined in part by a rotatable offset housing, a casing about the housing for altering a volume of the chamber, at least one vane seal between the housing and an inner surface of the casing for further defining the chamber, and a shifting head of uniform maximum outer diameter responsive to pressure in the operating fluid chamber;

the housing defining a head chamber to accommodate the shifting head, the head chamber having a tab for slidably interfacing with a parallel surface of a slot of the head to establish a set predetermined maximum range of motion for the head between fully extended and fully retracted position limits, the fully retracted position limit determined exclusively by the interfacing of the tab and slot;

a dedicated heat exchanger for supplying a heated operating fluid to the operating fluid chamber; and a dedicated cold exchanger for obtaining the operating fluid from the device upon rotation of the housing accommodating the shifting head.

8. The system of claim 7 wherein the housing is mechanically coupled to a shaft for rotation thereof and extending from the rotary device.

9. The system of claim 8 wherein the shaft is mechanically linked to at least one power retrieval device.

10. The system of claim 9 wherein the power retrieval device is one of a motor, a flywheel and a generator.

11. The system of claim 9 wherein the at least one power retrieval device is multiple power retrieval devices mechanically linked to one another.

12. The system of claim 7 wherein the dedicated heat exchanger is supplied with a heat flow of water for supplying the heat to the operating fluid.

13. The system of claim 7 wherein the operating fluid is a compressible fluid selected from a group consisting of supercritical $CO_2$, supercritical steam, supercritical helium and a non-supercritical fluid.

14. The system of claim 7 further comprising a recuperator in hydraulic communication with each of the cold exchanger and the heat exchanger for intermediate heat recovery and temperature regulation of the operating fluid.

15. A method of obtaining power from a system, the method comprising:

circulating operating fluid to a rotary positive displacement device for rotation thereof, the rotary positive displacement device comprising a rotatable offset housing defining an operating fluid chamber, a casing about the housing for altering a volume of the chamber, and at least one vane seal between the housing and an inner surface of the casing for further defining the chamber;

delivering a working force from the rotary device to actuate a power retrieval device for the obtaining of the power in response to the rotation;

shifting a position of a head of uniform maximum outer diameter in fluid communication with the rotary device to enhance the rotation; and maintaining the position of the head within a set predetermined maximum range of motion between fully extended and fully retracted position limits by a slidable interfacing of a tab at a parallel side of one of the head and a head chamber accommodating the head with a slot at a side of the other of the head and the head chamber, the fully retracted position limit determined exclusively by the interfacing of the tab and slot.

16. The method of claim 15 further comprising:

heating the operating fluid in advance of circulating to the rotary device;

circulating the operating fluid from the rotary device; and cooling the operating fluid.

17. The method of claim 16 wherein the heating of the operating fluid is facilitated by a heat exchanger with the aid of heated water by one of geothermal, solar and waste heat.

18. The method of claim 17 wherein the heating of the operating fluid is to a temperature of less than about 500°F.

19. The method of claim 16 wherein the cooling of the operating fluid is facilitated by a cold exchanger with the aid of one of water at room temperature and evaporatively cooled water.

* * * * *